US007680001B1

(12) United States Patent
D'Annunzio et al.

(10) Patent No.: US 7,680,001 B1
(45) Date of Patent: Mar. 16, 2010

(54) DEVICE AND METHOD FOR PREVENTING THE USE OF A COMPROMISED PHARMACEUTICAL THAT IS STORED IN A VIAL OR SIMILAR CONTAINER

(76) Inventors: Lindsay L. D'Annunzio, 21 Kerr Dr., Hamilton, NJ (US) 08610; Anthony J. D'Annunzio, 21 Kerr Dr., Hamilton, NJ (US) 08610; Courtney L. D'Annunzio, 21 Mallory Way, Hamilton, NJ (US) 08610; Russell A Shannon, 712 Red Bank Ave., Ocean Gate, NJ (US) 08740; John Quiter, 180 Mill Creek Rd., Bayville, NJ (US) 08721

( * ) Notice: Subject to any disclaimer, the term of this patent is extended or adjusted under 35 U.S.C. 154(b) by 92 days.

(21) Appl. No.: 11/985,813

(22) Filed: Nov. 19, 2007

(51) Int. Cl.
*G04B 47/00* (2006.01)
*B65D 39/00* (2006.01)
*G07F 11/00* (2006.01)

(52) U.S. Cl. ..... 368/10; 215/247; 215/311; 221/2

(58) Field of Classification Search ..... 368/10; 221/2, 3, 15; 215/247, 307, 311
See application file for complete search history.

(56) References Cited

U.S. PATENT DOCUMENTS 3,762,601 A * 10/1973 McLaughlin ..... 221/2
4,504,153 A * 3/1985 Schollmeyer et al. ..... 368/10
4,815,619 A 3/1989 Turner et al. ..... 215/248
6,131,399 A * 10/2000 Hall ..... 62/127
6,169,707 B1 * 1/2001 Newland ..... 368/10
6,259,654 B1 * 7/2001 de la Huerga ..... 368/10
6,810,350 B2 * 10/2004 Blakley ..... 702/130
2002/0047019 A1 * 4/2002 Devers ..... 221/2
2003/0183642 A1 * 10/2003 Kempker, Sr. ..... 221/2
2006/0071011 A1 * 4/2006 Varvarelis et al. ..... 221/9
2006/0192001 A1 * 8/2006 Shaffer et al. ..... 235/385
2006/0201961 A1 * 9/2006 Abdulhay et al. ..... 221/9
2006/0238338 A1 * 10/2006 Nanda ..... 340/540
2006/0256664 A1 * 11/2006 Varon ..... 368/89

* cited by examiner

*Primary Examiner*—Vit W Miska
(74) *Attorney, Agent, or Firm*—LaMorte & Associates

(57) ABSTRACT

A cap assembly for a container that holds a perishable product. The cap assembly defines an opening through which the perishable product inside the container can be accessed. At least one obstruction plate is present within the cap assembly. Each obstruction plate is positionable between an open position, where the obstruction plate is clear of the opening, and a closed position where the obstruction plate obstructs the opening. A mechanism is provided within the cap assembly that automatically moves each obstruction plate from its open position to its closed position when the shelf life of the perishable product has expired. Optionally, the cap assembly may also include at least one condition sensor for detecting a condition harmful to the perishable product in the container. The mechanism also closes each obstruction plate if such a harmful condition is detected by the condition sensor.

13 Claims, 7 Drawing Sheets

DEVICE AND METHOD FOR PREVENTING THE USE OF A COMPROMISED PHARMACEUTICAL THAT IS STORED IN A VIAL OR SIMILAR CONTAINER

BACKGROUND OF THE INVENTION

1. Field of the Invention

In general, the present invention relates to the structure of pharmaceutical vials and especially the structure of caps for such vials. The present invention also relates to electronic devices that monitor the viability of the contents of a pharmaceutical vial.

2. Prior Art Description

Many pharmaceutical products are administered by injection. In many instances, the pharmaceutical product is packaged in a vial by the manufacturer. To prevent contamination of the pharmaceutical product, the vial is sealed with a piercable cap. In order to access the contents of the vial, a needle from a hypodermic syringe must be driven through the structure of the cap. Once the tip of the needle is inside the vial, the pharmaceutical product can be drawn out of the vial by the operation of the syringe.

Some vials contain enough pharmaceutical product for a single dose to a single patient. Other vials contain enough pharmaceutical products for multiple patients. Vials that contain enough pharmaceutical product for multiple patients have a cap structure that will be pieced by multiple hypodermic syringes at various times. When the needle of a hypodermic syringe pierces a cap, it creates a hole. If this hole is not closed, the hole leaves a passage for bacteria, air, and moisture to contaminate the contents of the syringe. In order to prevent such contamination, many pharmaceutical manufacturers utilize safety caps on vials that automatically reseal each time they are pierced by a needle. Such safety caps are exemplified by U.S. Pat. No. 4,815,619 to Turner, entitled Medicament Vial Safety Cap. Additionally, industry utilizes single/multiple use pre-filled syringes for pharmaceutical product distribution to patients.

Many pharmaceutical products, such as vaccines, can be compromised not only by contamination but also by variations in temperature and the passage of time. Many pharmaceutical products have a posted shelf life. If the pharmaceutical product stands unused for longer than its shelf life, the pharmaceutical product loses potency and may no longer be effective. Furthermore, many pharmaceutical products are highly sensitive to temperature. If the temperature of a pharmaceutical product is too high, molecules within the product may break down. Likewise, if a pharmaceutical product becomes too cold, emulsions may separate into component ingredients. In either case, the pharmaceutical product may be rendered useless.

In order to monitor the temperature and shelf life of pharmaceutical products, electronic devices have been created that are packaged with the pharmaceutical products. Such electronic monitoring devices are exemplified by U.S. Pat. No. 6,810,350 to Blakely, entitled Determination Of Pharmaceutical Expiration Date. Such electronic devices produce an audible alarm if the pharmaceutical product is expired or has been temperature compromised. However, such prior art electronic monitoring devices have many disadvantages. Since such prior art monitoring devices are units that are separate and distinct from the vials/prepackaged syringes that hold the pharmaceutical product, the electronic devices are often attached to the packaging of the vial/prepackaged syringes or the shipping container of the vial. Once individual vials/prepackaged syringes are removed from their shipping containers, they become separated from the electronic monitoring device. The individual vials/prepackaged syringes may then become compromised without detection. Furthermore, prior art electronic monitoring devices are battery operated. If the battery dies, the electronic monitor stops working. A person may then think that a very old vial is good. The same situation may occur if the electronic monitoring device becomes damaged during shipping or accidentally gets wet and stops working.

A need therefore exists for an improved monitoring device that monitors the age and temperature history of a pharmaceutical product in a vial/prepackaged syringe, yet cannot be separated from the pharmaceutical vial/prepackaged syringe. A need also exists for a monitoring device that prevents a compromised pharmaceutical product from being used, even if the monitoring device itself is damaged. These needs are met by the present invention as described and claimed below.

SUMMARY OF THE INVENTION

The present invention is a cap assembly for a container that holds a perishable product, wherein the perishable product has a predetermined shelf life. The cap assembly attaches to the container. The cap assembly defines an opening through which the perishable product inside the container can be accessed. At least one obstruction plate is present within the cap assembly. Each obstruction plate is positionable between an open position, where the obstruction plate is clear of the opening, and a closed position where the obstruction plate obstructs the opening.

A mechanism is provided within the cap assembly that automatically moves each obstruction plate from its open position to its closed position when the shelf life of the perishable product has expired. Each plate is preferably red in color, or otherwise highly visible, to provide a clear indication that the perishable product is no longer useful. Optionally, the cap assembly may also include at least one condition sensor for detecting a condition harmful to the perishable product in the container. The mechanism may also close each obstruction plate if such a harmful condition is detected by a condition sensor.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be used to monitor the expiration date and the temperature history of many different types of perishable products, such as milk in a container, the present invention is especially well suited for monitoring such variables for a pharmaceutical product packaged in a vial. Accordingly, the first exemplary embodiment of the present invention shows its application to a vial in order to set forth the best mode contemplated for the invention. However, it will be understood that the use of the present invention on a vial is only one use and should not be considered a limitation.

Figure 1:
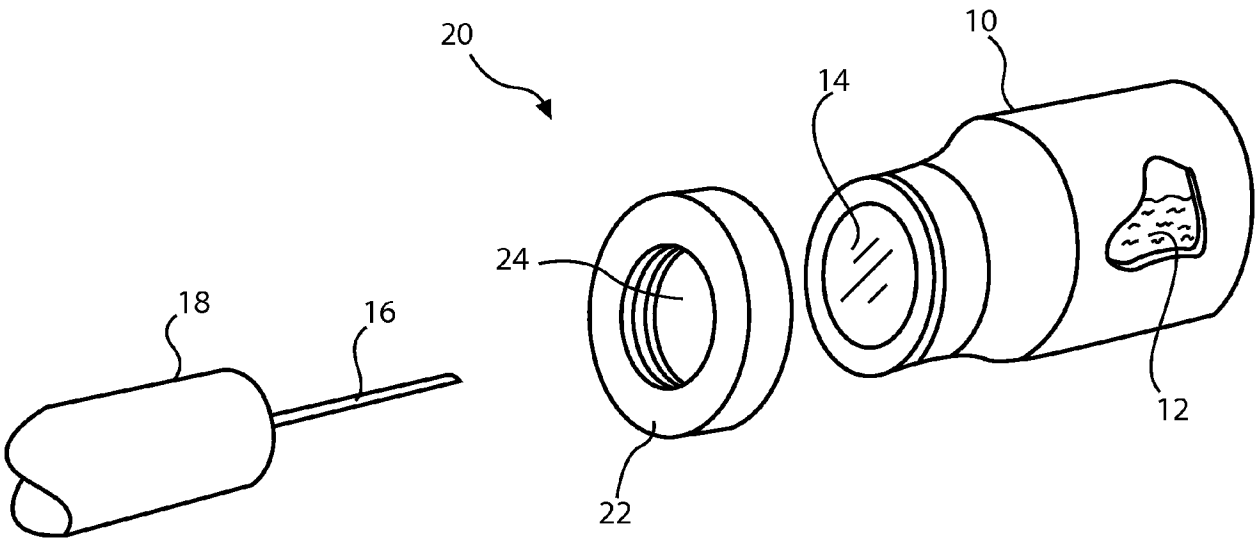
FIG. 1 is a perspective view of an exemplary embodiment of a cap assembly shown in an open condition in conjunction with a vial and the tip of a hypodermic syringe.

Referring to FIG. 1, a vial 10 of a pharmaceutical product 12 is shown. The vial 10 has a piercable barrier 14 that isolates the pharmaceutical product 12 inside the vial 10. A cap assembly 20 is provided. The cap assembly 20 has an annular housing 22 that defines a central opening 24. The cap assembly 20 is affixed to the vial 10 over the piercable barrier 14. In this manner, the piercable barrier 14 can only be accessed through the central opening 24 of the cap assembly 20. Preferably, the cap assembly 20 is crimped or otherwise permanently affixed to the vial 10.

If the pharmaceutical product 12 in the vial 10 is uncompromised, the central opening 24 in the cap assembly 10 remains unobstructed. The needle 16 of a hypodermic syringe 18 can therefore be advanced through the central opening 24 and into the pierceable barrier 14. The pharmaceutical product 12 can therefore be drawn into the hypodermic syringe 18 in the same manner as if the cap assembly 20 were not present.

Figure 2:
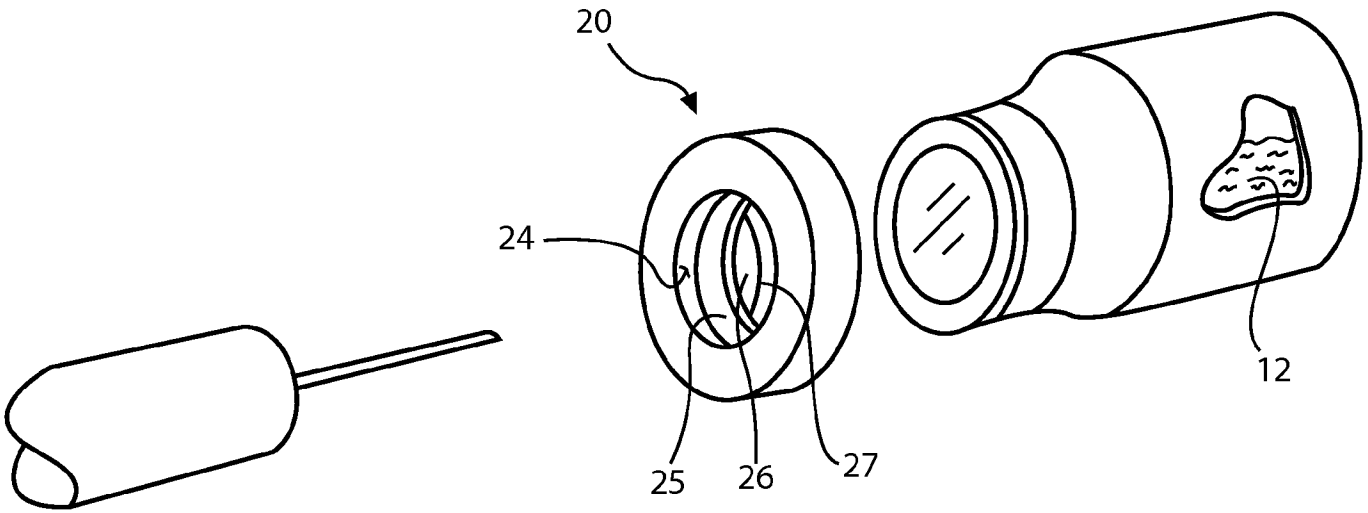
FIG. 2 is a perspective view of an exemplary embodiment of a cap assembly shown in a closed condition in conjunction with a vial and the tip of a hypodermic syringe.

Referring to FIG. 2, it can be seen that inside the cap assembly 20, there is at least one obstruction plate. If the pharmaceutical product 12 becomes expired or is compromised by temperature, then the obstruction plates 25, 26, 27 automatically rotate in front of the central opening 24. The obstruction plates 25, 26, 27 block the central opening 24 of the cap assembly 20 and physically prevent the needle 16 of a hypodermic syringe 18 from reaching the vial 10. In this manner, if the pharmaceutical product 12 inside the vial 10 is compromised, it cannot even be accidentally accessed. The obstruction plates 25, 26, 27 are preferably brightly colored so that it can be easily observed that a pharmaceutical product 12 is compromised and that the obstruction plates 25, 26, 27 have closed.

Figure 3:
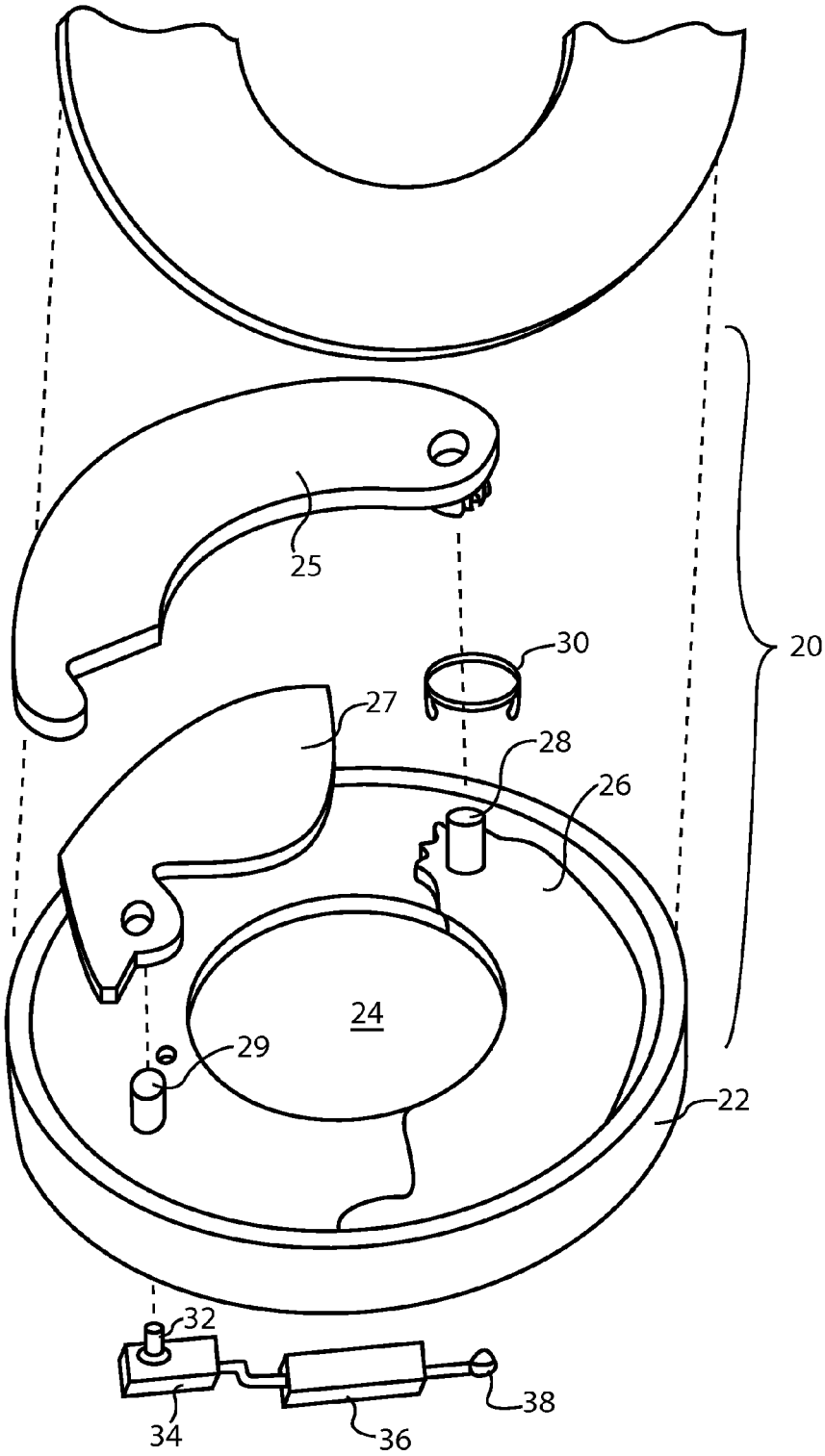
FIG. 3 is an exploded perspective view of the cap assembly.
Figure 4:
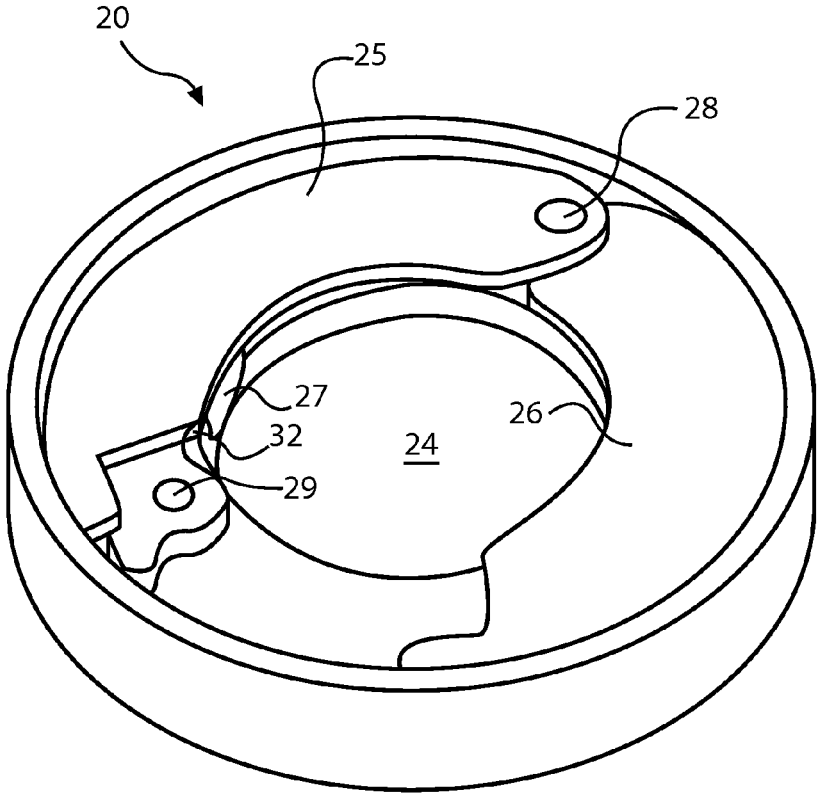
FIG. 4 is an enlarged view of the cap assembly in an open condition.
Figure 5:
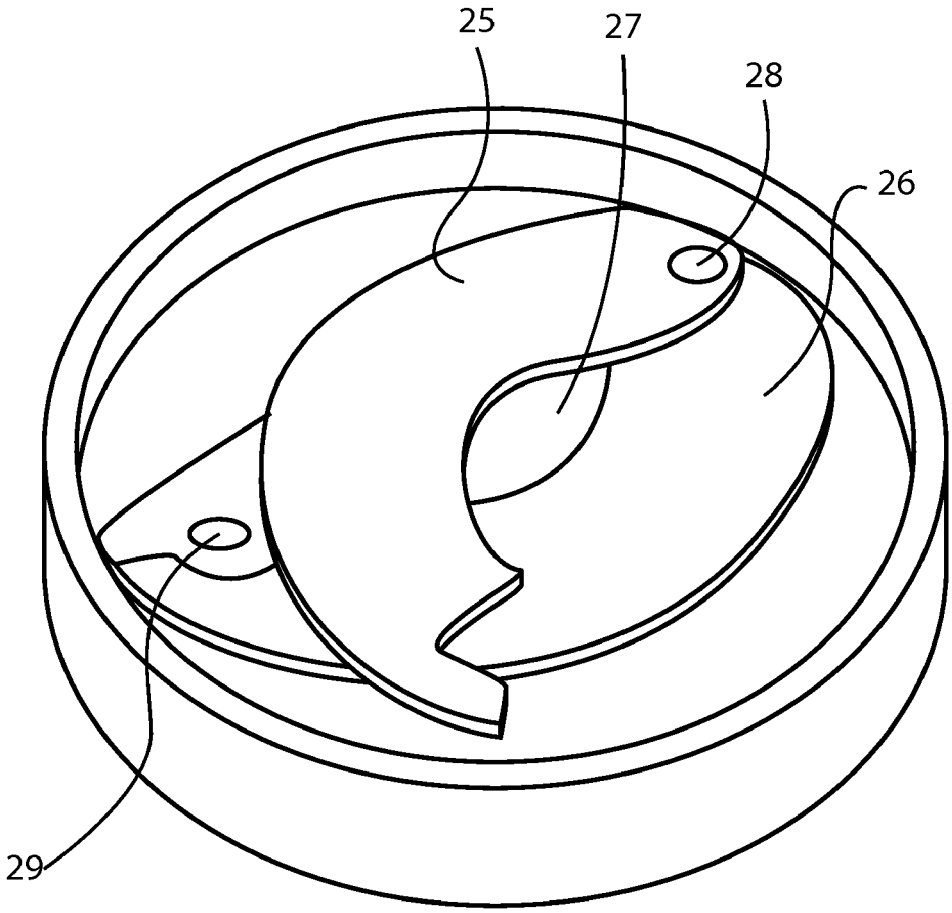
FIG. 5 is an enlarged view of the cap assembly in a closed condition.

Referring to FIG. 3 in conjunction with both FIG. 4 and FIG. 5, it can be seen that inside the cap assembly 20 are three obstruction plates 25, 26, 27. The first and second obstruction plate 25, 26 connect to a first pivot pin 28. The third obstruction plate 27 attaches to a second pivot pin 29. A spring 30 is provided that biases the first and second obstruction plates 25, 26 into a closed orientation. (Shown in FIG. 5) When the second obstruction plate 26 closes, it contacts the third obstruction plate 27 and rotates the third obstruction plate 27 around the second pivot pin 29 into a closed orientation.

The first, second and third obstruction plates 25, 26, 27 can be rotated into an open position. (Shown in FIG. 4) When in the open position, none of the obstruction plates 25, 26, 27 extend into the central opening 24 of the housing 22. The central opening 24 therefore remains unobstructed and access through the central opening 24 is uninhibited.

The obstruction plates 25, 26, 27 are held open against the bias of the spring 30 by a trigger pin 32. As is shown in FIG. 5, when the obstruction plates 25, 26, 27 are in the open position, the trigger pin 32 holds the first and third obstruction plates 25, 27 open.

Referring to FIG. 3, it can be seen that the trigger pin 32 is connected to a mechanical activator 34. The mechanical activator 34 is connected to a control circuit 36. The control circuit 36 monitors temperature and time using a temperature sensor 38 and an internal clock. If the control circuit 36 detects the passage of a preprogrammed time period or detects an unacceptable temperature condition, then the control circuit 36 instructs the mechanical activator 34 to move the trigger pin 32. The obstruction plates 25, 26, 27 then move from the open position shown in FIG. 4 to the closed position shown in FIG. 5.

It is preferred that the closed orientation of the obstruction plates 25, 26, 27 be the failsafe position. In this manner, should the battery that powers the cap assembly 20 fail, or should the electronics become damaged, the obstruction plates 25, 26, 27 automatically move from the open position of FIG. 4 to the closed position of FIG. 5.

Figure 6:
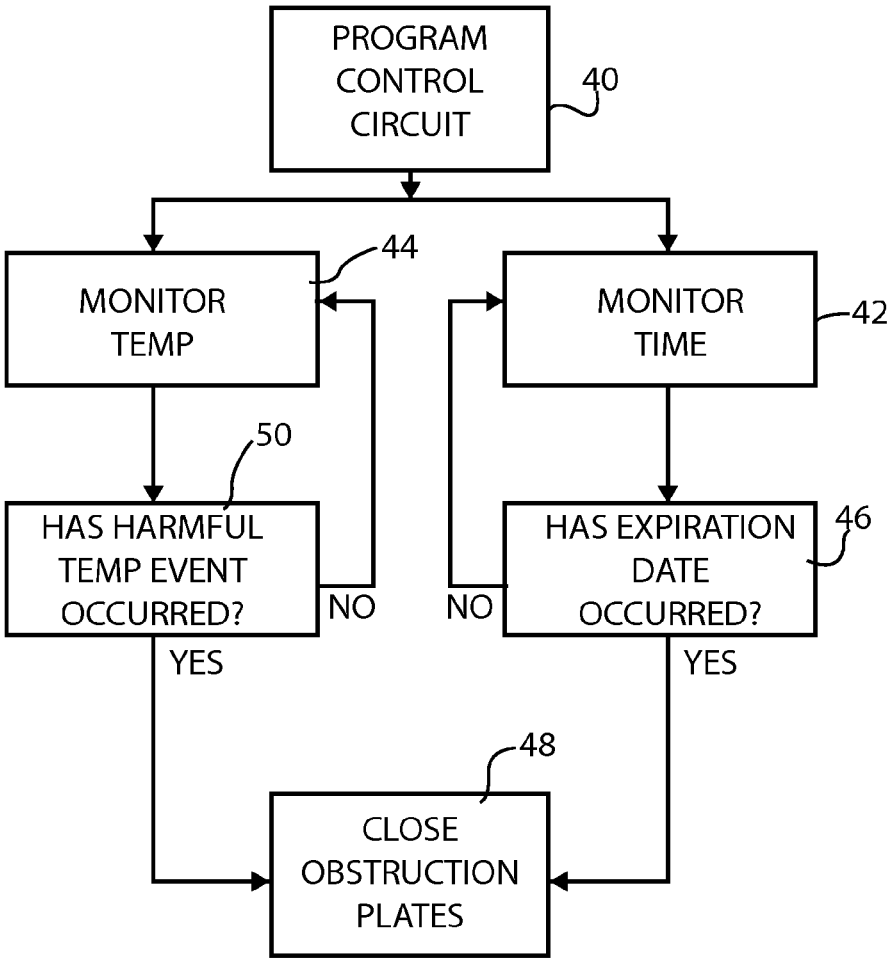
FIG. 6 is a block diagram showing an exemplary method of operation.

Referring to FIG. 6 in conjunction with FIG. 3, a preferred method of operation for the cap assembly 20 can be described. As is indicated by Block 40, the expiration date and temperature parameters for a particular pharmaceutical product are entered into the control circuit 36. This can be done during the manufacture of the control circuit 36, or afterwards by programming a memory chip built into the control circuit 36.

Once the control circuit 36 has the data for the expiration date and temperature criteria, the control circuit 36 monitors both time and temperature. See Blocks 42, 44. Time is monitored by a clock built into the control circuit 36. As can be seen from Block 46, the control circuit 36 compares the elapsed time to the shelf life of the pharmaceutical product. If the elapsed time exceeds the shelf life, then the control circuit 36 triggers the mechanical activator 34 and the obstruction plates 25, 26, 27 move from their open position into their closed position. See Block 48.

Temperature is monitored by a temperature sensor 38 that is connected to the control circuit 36. If the cap assembly 20 experiences an out-of-range temperature for a predetermined period of time, then the control circuit 36 triggers the mechanical activator 34 and the obstruction plates 25, 26, 27 move from their open position into their closed position. See Blocks 50 and 48. Brief exposures to high or low temperatures do not cause the control circuit to trigger the mechanical activator 34. Rather, the exposure to a temperature extreme must be for a period of time sufficient to compromise the integrity of the pharmaceutical product being stored. It will therefore be understood that the control circuit monitors its internal clock while detecting a temperature extreme.

The criteria for expiration date and temperature parameters vary widely for different pharmaceuticals. Some pharmaceutical products can only be kept for short times in narrow temperature ranges. Other pharmaceuticals can last for years at most any temperature. The sensitivity of the temperature sensor and the precision of the clock can therefore be altered to match the needs of a specific pharmaceutical product.

Figure 7:
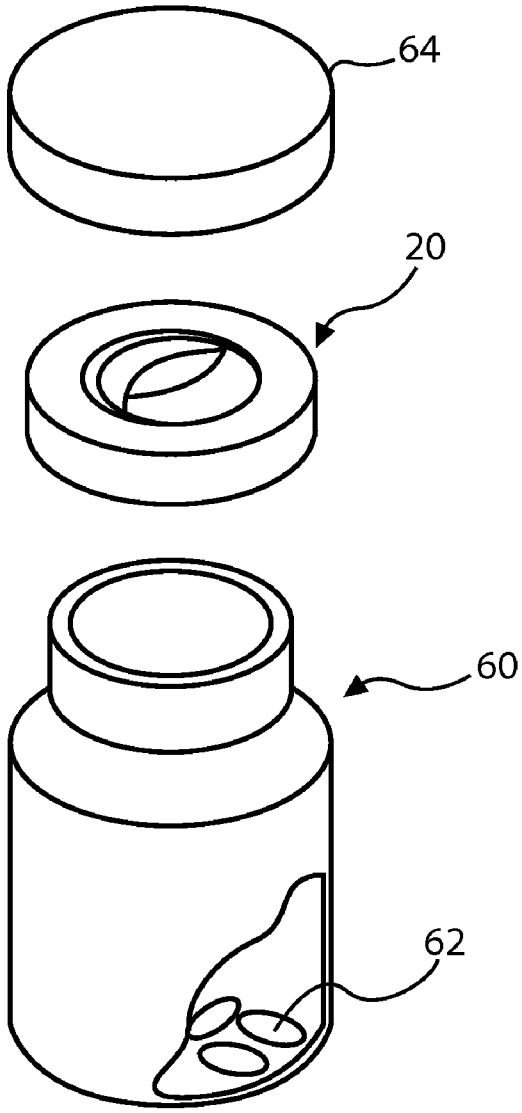
FIG. 7 is a selectively fragmented view of a pill container containing the present invention cap assembly.

In the first embodiment of the present invention that is presented, the cap assembly 20 is used to stop access to a vial, should the contents of the vial become compromised. Referring to FIG. 7, an alternate embodiment of the present invention is shown. In the embodiment of FIG. 7, a container 60 of pills 62 is shown. The cap assembly 20 is attached to the top of the container 60. A safety cap 64 is then used to cover the cap assembly 20.

In use, a person opens the safety cap 64 and shakes the pills 62 out of the container 60 for consumption. The pills 62 pass through the central opening 24 in the center of the cap assembly 20. However, if the pills 62 have expired or have been compromised by temperature, then the cap assembly 20 automatically closes. Once the cap assembly 20 closes, the pills 62 can no longer be removed from the container 60.

It will be understood that the embodiments of the present invention that are described are merely exemplary and that a person skilled in the art can make many variations to those embodiments using functionally equivalent parts. For instance, in the shown embodiments, a sensor for temperature is provided. Other sensors, such as sensors for humidity or light exposure can also be used. Obviously, such sensors would be used with pharmaceutical products that are adversely affected by humidity and/or light. All such variations, modifications, and alternate embodiments are intended to be included within the scope of the present invention as claimed.

What is claimed is:

1. A cap assembly for a container that holds a perishable product, wherein the perishable product has a predetermined shelf life, said cap assembly comprising:

a cap housing that defines an opening through which said perishable product in said container can be accessed;

at least one obstruction plate coupled to said cap housing, wherein said obstruction plate is positionable between an open position, where said at least one obstruction plate is clear of said opening and a closed position where said at least one obstruction plate obstructs said opening;

a clock that measures when said predetermined shelf life has expired;

at least one condition sensor for detecting at least one condition of said perishable product in said container; and a mechanism for automatically moving said at least one obstruction plate from said open position to said closed position upon a first occurrence of said predetermined shelf life having expired or said at least one condition sensor sensing a condition outside a predetermined range.

2. The cap assembly according to claim 1, wherein said at least one obstruction plate is biased into said closed position and is held in said open position by said mechanism.

3. The cap assembly according to claim 1, wherein said cap housing is annular and defines a central opening.

4. The cap assembly according to claim 1, wherein said at least one condition sensor is selected from a group consisting of temperature sensors, humidity sensors and light sensors.

5. A method of preventing a person from accessing a container filled with a perishable product whose quality may have been compromised, said method comprising the steps of:

providing a cap assembly for said container, said cap assembly including an opening, wherein said perishable product can only be accessed through said opening, said cap assembly further including a mechanism for selectively obstructing said opening;

detecting if said perishable product has been exposed to a harmful condition that may result in compromised quality, wherein said harmful condition is selected from a group consisting of exposure to a temperature outside an acceptable temperature range, high humidity and exposure to light; and automatically activating said mechanism in said cap assembly to obstruct said opening when said harmful condition has been detected.

6. The method according to claim 5, wherein said harmful condition is a predetermined period of time.

7. The method according to claim 5, wherein said step of providing a cap assembly for said container includes permanently attaching said cap assembly to said container.

8. The method according to claim 5, wherein said mechanism in said cap assembly includes at least one obstruction plate that can be moved between an open position and a closed position, wherein said at least one obstruction plate obstructs said opening when in said closed position.

9. The method according to claim 8, wherein said at least one obstruction plate is biased in said closed position.

10. A safety vial assembly, comprising:

a vial container having an open neck;

a volume of pharmaceutical product held within said vial container in liquid form, said pharmaceutical product being suitable for safe use within a predetermined period of time;

a piercable barrier obstructing said open neck and isolating said pharmaceutical product in said vial container, wherein said piercable barrier is selectively piercable by the needle of a hypodermic syringe;

a cap housing mounted to said vial over said piercable barrier, said cap housing defining an access opening through which said needle can directly access said piercable barrier;

a clock circuit;

at least one obstruction supported by said cap housing, wherein said at least one obstruction is positionable to a closed position where said at least one obstruction blocks said access opening in said cap housing; and a mechanism that moves said at least one obstruction to said closed position when said clock circuit detects when said predetermined period of time has passed.

11. The assembly according to claim 10, further including at least one condition sensor for detecting at least one condition of said pharmaceutical product in said vial container.

12. The assembly according to claim 11, wherein said mechanism moves said at least one obstruction to said closed position when said at least one condition sensor detects a condition outside a predetermined range.

13. The cap assembly according to claim 12, wherein said at least one condition sensor is selected from a group consisting of temperature sensors, humidity sensors and light sensors.

* * * * *